US007594622B2

(12) United States Patent
Witt et al.

(10) Patent No.: US 7,594,622 B2
(45) Date of Patent: Sep. 29, 2009

(54) METHOD AND APPARATUS FOR CONTROLLING A DISPENSER TO CONSERVE TOWEL DISPENSED THEREFROM

(75) Inventors: Sigurdur S. Witt, Ashwaubenon, WI (US); James A. Rodrian, Grafton, WI (US)

(73) Assignee: Alwin Manufacturing Co., Inc., Green Bay, WI (US)

( * ) Notice: Subject to any disclaimer, the term of this patent is extended or adjusted under 35 U.S.C. 154(b) by 478 days.

(21) Appl. No.: 11/537,867

(22) Filed: Oct. 2, 2006

(65) Prior Publication Data

US 2007/0080255 A1 Apr. 12, 2007

(51) Int. Cl.
*B65H 63/08* (2006.01)

(52) U.S. Cl. ..... 242/563.2; 318/272

(58) Field of Classification Search ..... 242/563, 242/563.2; 318/272, 139, 754, 138, 439; 220/551

See application file for complete search history.

(56) References Cited

U.S. PATENT DOCUMENTS

| | | | | |
|---|---|---|---|---|
| 4,450,398 | A | 5/1984 | Bose | |
| 4,463,426 | A | 7/1984 | Caddick et al. | |
| 4,738,176 | A | 4/1988 | Cassia | |
| 5,497,326 | A | 3/1996 | Berland et al. | |
| 5,514,977 | A | 5/1996 | Agiman | |
| 5,772,291 | A | 6/1998 | Byrd et al. | |
| 6,068,209 | A * | 5/2000 | Nakamura | 242/563.2 |
| 6,069,354 | A * | 5/2000 | Alfano et al. | 242/563 |
| 6,105,898 | A | 8/2000 | Byrd et al. | |
| 6,243,635 | B1 | 6/2001 | Swan et al. | |
| 6,262,546 | B1 | 7/2001 | Draves et al. | |
| 6,293,486 | B1 | 9/2001 | Byrd et al. | |
| 6,695,246 | B1 | 2/2004 | Elliott et al. | |
| 6,903,654 | B2 | 6/2005 | Hansen et al. | |
| 6,977,588 | B2 | 12/2005 | Schotz et al. | |
| 6,988,689 | B2 * | 1/2006 | Thomas et al. | 242/563 |
| 7,084,592 | B2 | 8/2006 | Rodrian | |
| 7,341,170 | B2 * | 3/2008 | Boone | 242/563 |
| 7,398,944 | B2 * | 7/2008 | Lewis et al. | 242/563 |
| 2001/0001475 | A1 * | 5/2001 | Formon et al. | 242/563.2 |
| 2003/0107341 | A1 | 6/2003 | Morris | |
| 2003/0168549 | A1 * | 9/2003 | Formon et al. | 242/563 |
| 2004/0041057 | A1 * | 3/2004 | Byrd et al. | 242/563 |
| 2004/0052197 | A1 | 3/2004 | Okajima | |
| 2004/0133378 | A1 | 7/2004 | Todd et al. | |
| 2004/0135027 | A1 | 7/2004 | Elliott et al. | |
| 2005/0077419 | A1 | 4/2005 | Thomas et al. | |
| 2006/0175341 | A1 | 8/2006 | Rodrian | |

OTHER PUBLICATIONS

PCT Serial No. PCT/US07/21176, Notification of Transmittal of the International Search Report and the Written Opinion of the International Searching Authority (10 pages). Dated: May 5, 2008.

* cited by examiner

*Primary Examiner*—William A Rivera
(74) *Attorney, Agent, or Firm*—Jansson Shupe & Munger Ltd.

(57) ABSTRACT

Towel dispensing methods and automatic towel dispensers permitting conservation of the overall amount of towel dispensed. The towel dispensing methods and towel dispensers limit the amount of towel dispensed in dispense cycles which occur shortly after an initial dispense cycle. The user is provided with sufficient towel to meet the user's needs while reducing overall towel usage and limiting towel waste.

20 Claims, 15 Drawing Sheets

METHOD AND APPARATUS FOR CONTROLLING A DISPENSER TO CONSERVE TOWEL DISPENSED THEREFROM

FIELD

The field relates generally to the field of controls and, more particularly, to methods and apparatus for controlling towel dispenser operation and the amount of towel dispensed therefrom.

BACKGROUND

Automatic towel dispensers are well-known devices used to provide towel to users for many purposes including personal hygiene, food preparation and general maintenance of cleanliness. Automatic towel dispensers typically use a motor-powered dispensing mechanism to dispense the towel from the dispenser to a user. Automatic towel dispensers may be used with a range of materials but are commonly used to dispense paper towel in the form of web. The term "towel" as used herein is intended to be expansive in meaning and is intended to include paper and other types of materials. Examples of other materials capable of being dispensed from an automatic dispenser are kraft paper, plastic food wrap and toilet tissue. The specific type of material comprising the towel is not critical provided that the material can be dispensed from an automatic dispenser.

One important issue facing manufacturers of automatic towel dispensers is the need to provide the user with a length of towel sufficient to meet the user's needs while at the same time avoiding the dispensing of excessive and wasteful amounts of towel. Typically, this objective is achieved by controlling the dispensing mechanism during a dispense cycle so that towel is dispensed in an amount estimated to be sufficient to meet the needs of the average user. A further control is typically provided to impose a delay between dispense cycles to prevent immediate cycling of the dispenser and dispensing of excessive lengths of towel. The delay prevents a subsequent dispense cycle from being initiated immediately after completion of a preceding dispense cycle. The delay is typically in the range of about one to four seconds in duration.

For some users, the length of towel dispensed in the dispense cycle may be insufficient. With a conventional dispenser, the user would be required to initiate a new dispense cycle to obtain additional towel. However, the length of towel dispensed in two dispense cycles may be more than that needed by the user and may amount to waste. And, a user might find it inconvenient to wait as much as four seconds for initiation of a subsequent dispense cycle.

There is a need for improvement in these and other aspects of automatic dispenser design and operation.

SUMMARY

Methods for controlling operation of an automatic towel dispenser to provide towel sufficient to meet the user's needs yet conserve the overall amount of towel dispensed and automatic dispensers so controlled are described herein. This result is achieved by limiting the length of towel dispensed from the automatic dispenser in a dispense cycle or cycles occurring shortly after an initial dispense cycle. The user receives a full length of towel in an initial dispense cycle and a partial length of towel in each subsequent dispense cycle or cycles occurring shortly after the initial dispense cycle. The user is able to obtain enough towel to meet the user's needs by triggering dispenser operation as many times as needed to obtain the desired amount of towel.

To the extent that a partial length of towel is sufficient to meet the user's needs, the difference between the partial towel length dispensed and the full towel length is conserved for use by another user. A significant amount of towel is conserved over the useful life of the dispenser thereby limiting waste and reducing the cost to operate the dispenser.

Many dispenser embodiments may be controlled according to the methods described herein and there is no single form of dispensing apparatus which is required. In certain embodiments, a suitably controlled automatic towel dispenser may include a housing adapted to receive a roll of towel, an electrically-powered dispensing mechanism adapted to dispense the towel from the dispenser and a controller operable to control the dispensing mechanism.

In preferred embodiments, the controller controls the dispensing mechanism to dispense a full length of towel in a dispense cycle responsive to a user request from the user. If a further user request is made within a preset time following initiation of such dispense cycle, the controller further controls the dispensing mechanism to dispense a partial length of towel in the subsequent dispense cycle. On the other hand, if the further user request is made after the preset time, then the controller controls the dispensing mechanism to dispense a full length of towel in the subsequent dispense cycle.

In preferred embodiments, the controller comprises a processor, a memory and a set of instructions programmed to control the dispensing mechanism. Various other features, such as a proximity detector, may be included as desired.

BRIEF DESCRIPTION OF THE DRAWINGS

The invention may be understood by reference to the following description taken in conjunction with the accompanying drawings, in which like reference numerals identify like elements throughout the different views. The drawings are not necessarily to scale, emphasis instead being placed upon illustrating the principles of the invention. In the accompanying drawings.

Figure 1:
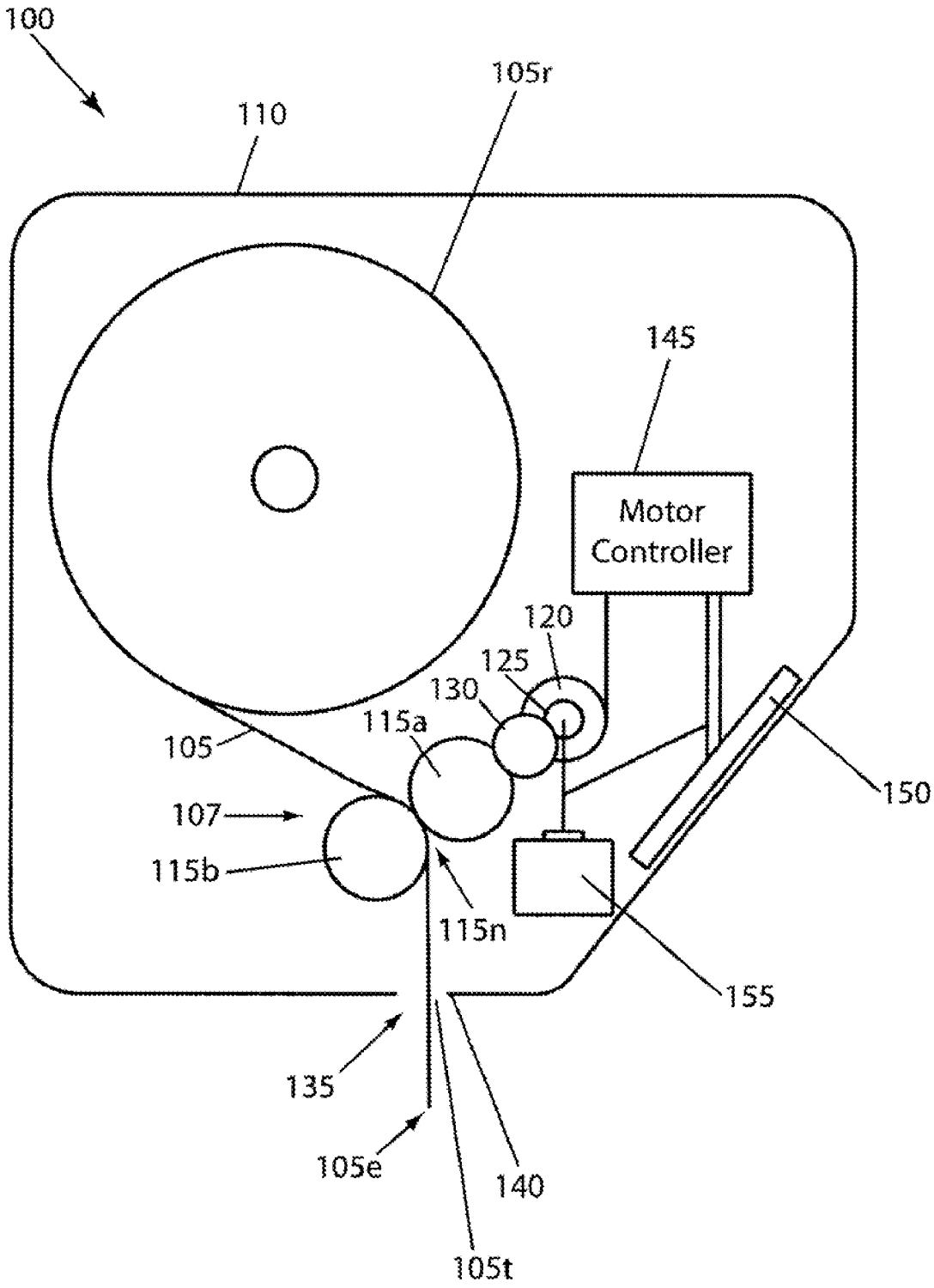
FIG. 1 is a simplified diagram of an automatic paper towel dispenser in accordance with one embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Methods and apparatus for controlling operation of an automatic towel dispenser in accordance with the invention will be described in connection with automatic towel dispenser embodiment 100. Dispenser 100 is of a type useful in dispensing paper towel 105 which is in the form of a web. Embodiments include dispensers suitable for dispensing materials other than paper towel including, kraft paper, plastic food wrap, toilet tissue and other materials.

Advantageously, the invention may be implemented with any type of automatic towel dispenser capable of being controlled to lengthen or shorten the towel dispensed in a dispense cycle. Examples of automatic towel dispensers in which the invention may be implemented are described in related U.S. Pat. No. 7,084,592 the entire content of which is incorporated by reference. Further exemplary automatic towel dispensers capable of implementing the invention are described in commonly owned U.S. Pat. Nos. 6,903,654 and 6,977,588 and in co-pending U.S. Patent Application Ser. No. 60/749,139, the contents of each of which are incorporated herein by reference in their entirety. Many other types of automatic towel dispensers may be controlled according to the improvement and the specific type of dispenser embodiment utilized is not critical. The present invention represents an improvement and enhancement to operation of automatic towel dispensers, such as those referenced above, wherein the dispenser is controlled to provide sufficient towel to meet the user's needs yet conserve the overall amount of towel dispensed over the useful life of the dispenser.

Referring then to FIG. 1, a simplified diagram of an automatic towel dispenser 100 in accordance with one embodiment of the present invention is provided. The automatic towel dispenser 100 includes a roll 105*r* of paper towel 105 material supported in a housing 110. The paper towel 105 is in the form of a web. Roll 105*r* is mounted on roll holders (not shown) and rotates as towel 105 is unwound from roll 105*r*.

An electrically-powered dispensing mechanism 107 is provided to dispense the towel 105 from the dispenser 100. In the example shown, dispensing mechanism 107 includes rollers 115*a*, 115*b*, motor 120, shaft 125 and gear 130. The paper 105 passes through rollers 115*a* and 115*b*. Roller 115*a* is a drive roller and roller 115*b* is a tension roller. Tension roller 115*b* is urged tightly against drive roller 115*a*, typically by a spring-loaded mechanism (not shown), to form a nip 115*n* between rollers 115*a* and 115*b*. A DC motor 120 has a shaft 125 mechanically linked to, and in power-transmission relationship with, at least one of the rollers 115*a* through a gear 130 or some other type of linkage. Paper is pulled from roll 105 and through nip 115*n* by motor-powered 120 rotation of drive roller 115*a*. Paper towel 105 is dispensed through a slot 135 in the housing 110. One edge 140 of slot 135 may have a serrated surface to cut the paper as a user grasps the paper extending beyond slot 135.

A motor controller 145 receives an input from a proximity sensor 150 and controls the motor 120 to dispense either a full length of towel 105 or a partial length of towel in a dispense cycle. A "full length" means or refers to a selected towel length estimated by the dispenser manufacturer or operator to be sufficient to meet the needs of the user. A "partial length" means or refers to a towel length which is less than that of the full length. Length simply refers to the amount of towel dispensed, measured end-to-end. A length of towel is measured from the leading end 105*e* of the towel 105 protruding from the dispenser 100 (also referred to in industry as a "tail") to the trailing end 105*t* of the towel 105 defining a single portion or sheet of towel. A "dispense cycle" means or refers to an operational cycle of the dispenser resulting in dispensing of a length of the towel responsive to a request for a towel by a user.

Typically, a full towel length is about 8 to 12 inches in length with 10 to 12 inches being preferred. A partial towel length would preferably be about half the full length, or about 4 to 6 inches with 5 to 6 inches being preferred. It should be clearly understood that any particular length is approximate only and that the actual length of towel dispensed may vary from dispense cycle to dispense cycle. Motor controller 145 may be preset by the manufacturer to control motor 120 to dispense the desired lengths of towel or may be provided with a control permitting the operator to set the lengths of towel to be dispensed.

An electrical power source, preferably in the form of battery 155, is provided for powering components, such as the motor 120, motor controller 145, and proximity sensor 150. Other electrical power sources, such as a DC transformer (not shown), may be used to supply electrical power to automatic towel dispenser 100. The arrangement of the components in the paper towel dispenser 100 illustrated in FIG. 1 is merely exemplary and is not intended to represent an actual physical implementation.

A human user initiates operation of the dispenser 100 in a dispense cycle by placing his or her body, typically the user's hand, proximate the dispenser 100 in order to trigger detection by proximity detector 150. A signal is generated by proximity detector 150 and is communicated to motor controller 145 indicating the user's presence at dispenser 100. This user-initiated operation of dispenser 100 is referred to herein as a "user request." Any suitable proximity detector may be utilized. Examples of proximity detectors suitable for use in dispenser 100 are described in previously-identified U.S. Pat. Nos. 6,903,654 and 6,977,588 and co-pending U.S. Patent Application Ser. No. 60/749,139.

It is not necessary that a user request be communicated to dispenser 100 motor controller 145 by means of proximity detector 150. Any suitable control may be utilized to communicate the user request to motor controller 145. For instance, a simple contact switch in the form of a push button (not shown) on the dispenser 100 may be provided in combination with, or in place of, proximity detector 150. A user could make the user request simply by pressing the button of the contact switch, closing the switch and sending a signal to the motor controller 145.

Figure 2:
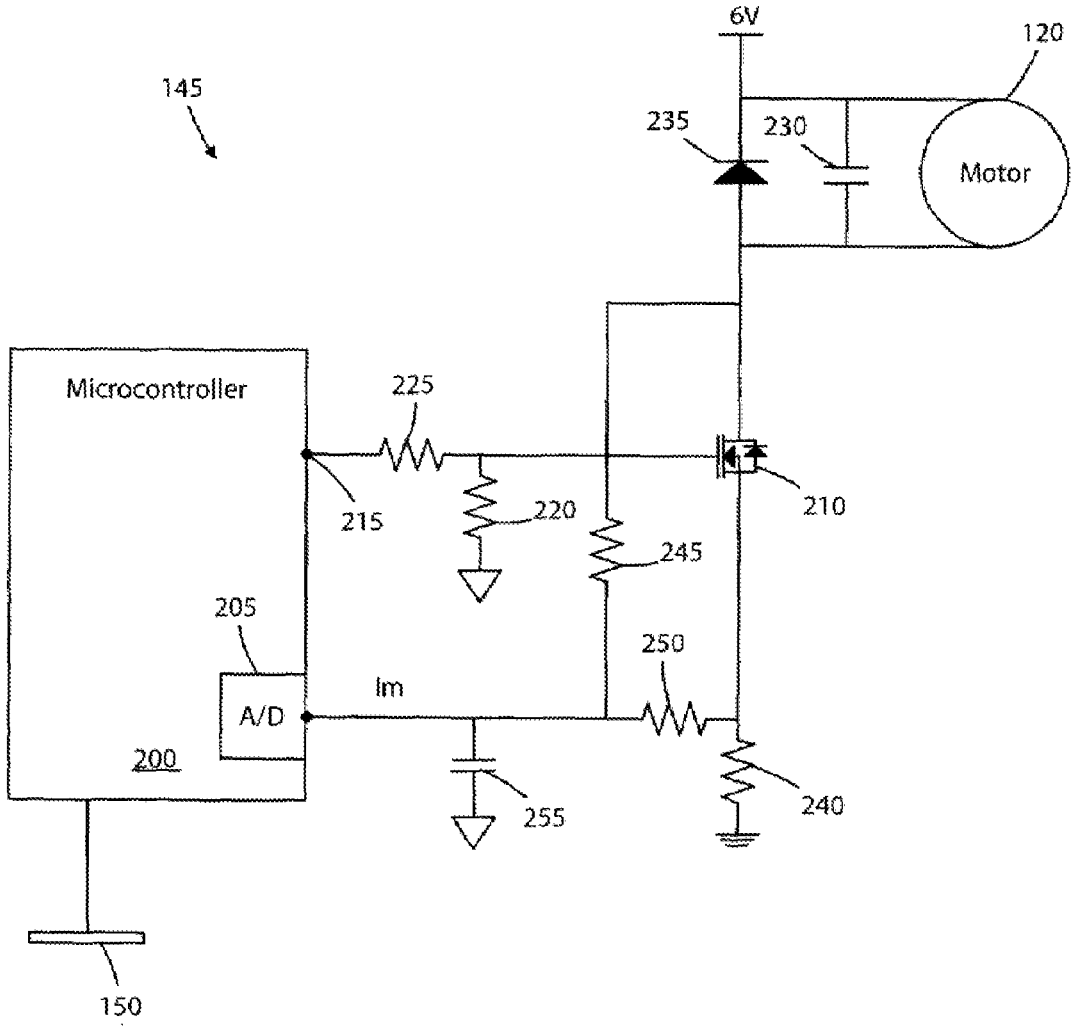
FIG. 2 is a simplified block diagram of a motor controller in accordance with the present invention and which may be used with the dispenser of FIG. 1.

Turning now to FIG. 2, a simplified block diagram of motor controller 145 is provided. Motor controller 145 includes a processing device in the form of microcontroller 200 programmed with software instructions for implementing the functions described in greater detail below. Microcontroller 200 includes an integrated analog-to-digital (A/D) converter 205 that measures the motor current digitally.

Microcontroller 200 employs the data collected by A/D converter 205 to detect the pulses in the motor current (Im) and control motor 120 accordingly. An exemplary microcontroller suitable for performing the functions described herein is a model number MSP430F1122IPW offered commercially by Texas Instruments, Inc. of Dallas, Tex. As described in greater detail below, microcontroller 200 may be configured to implement differing pulse counting techniques depending on the particular characteristics of the automatic dispenser in which it is employed (e.g., the paper towel dispenser 100).

Motor controller 145 includes a field effect transistor 210, connected to an activation output terminal 215 of microcontroller 200 for activating motor 120. A resistor 220 is provided to ensure that transistor 210 is deactivated after a reset of microcontroller 200 before its I/O ports are initialized. A resistor 225 limits short-term oscillation that may occur at the input of transistor 210 when it is activated. A capacitor 230 is coupled across the terminals of motor 120 to reduce radiation of RF energy due to brush noise (commutator switching noise) in motor 120. A diode 235 is also provided across the motor terminals to suppress a voltage spike that may occur when motor 120 is turned off.

A first current sensing resistor 240 is provided to generate a voltage proportional to motor current Im when motor 120 is activated through transistor 210. A second resistor 245 bypasses transistor 210 and generates a voltage proportional to motor current Im when motor 120 is turned off, and first current sensing resistor 240 is isolated by transistor 210. The resistors 245, 250 and capacitor 255 are provided to act as a low-pass anti-aliasing filter on the motor current Im input signal.

The operation of motor controller 145 with respect to control of motor 120 to provide towel sufficient to meet the user's needs yet conserve the overall amount of towel dispensed is described in connection with FIGS. 4A through 7C. Before describing the towel-conserving logic implemented in these embodiments of dispenser 100, a digital pulse-counting system for towel-length control using digital signal techniques is discussed. Three different embodiments of such digital pulse-counting system are presented later in this document.

Figure 3A:
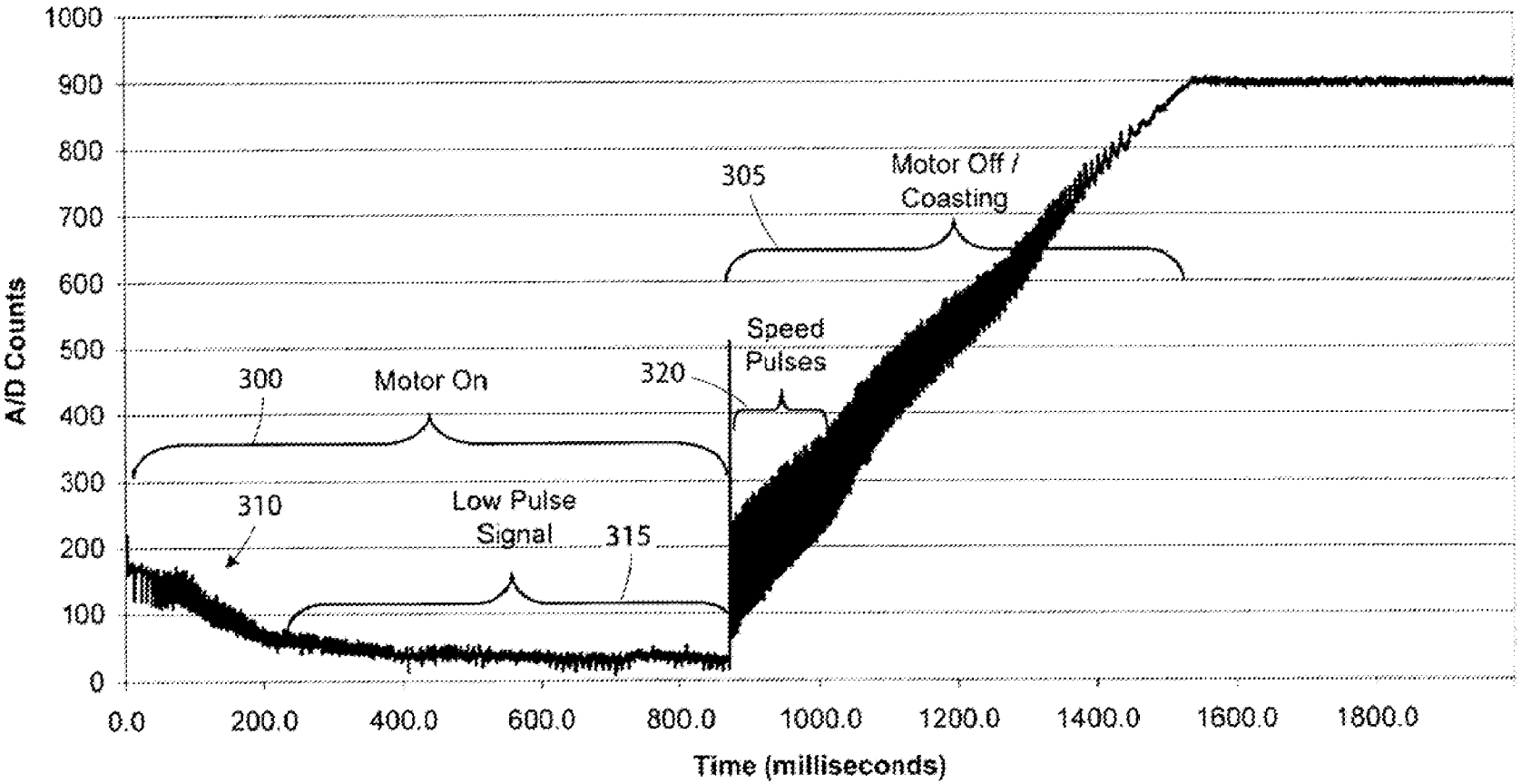
FIGS. 3A, 3B, and 3C are graphs illustrating motor current during different motor operating intervals.
Figure 3B:
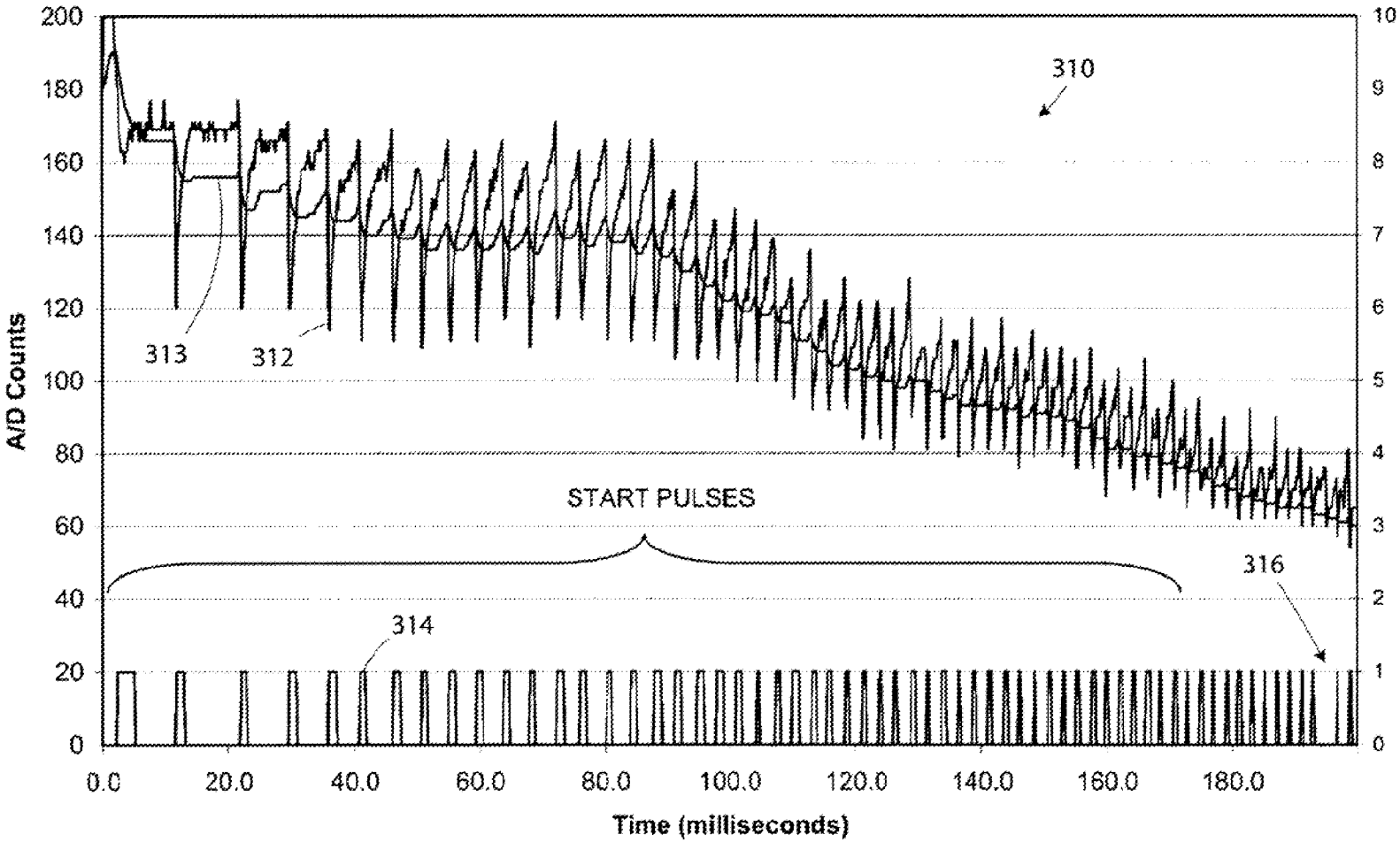
Figure 3C:
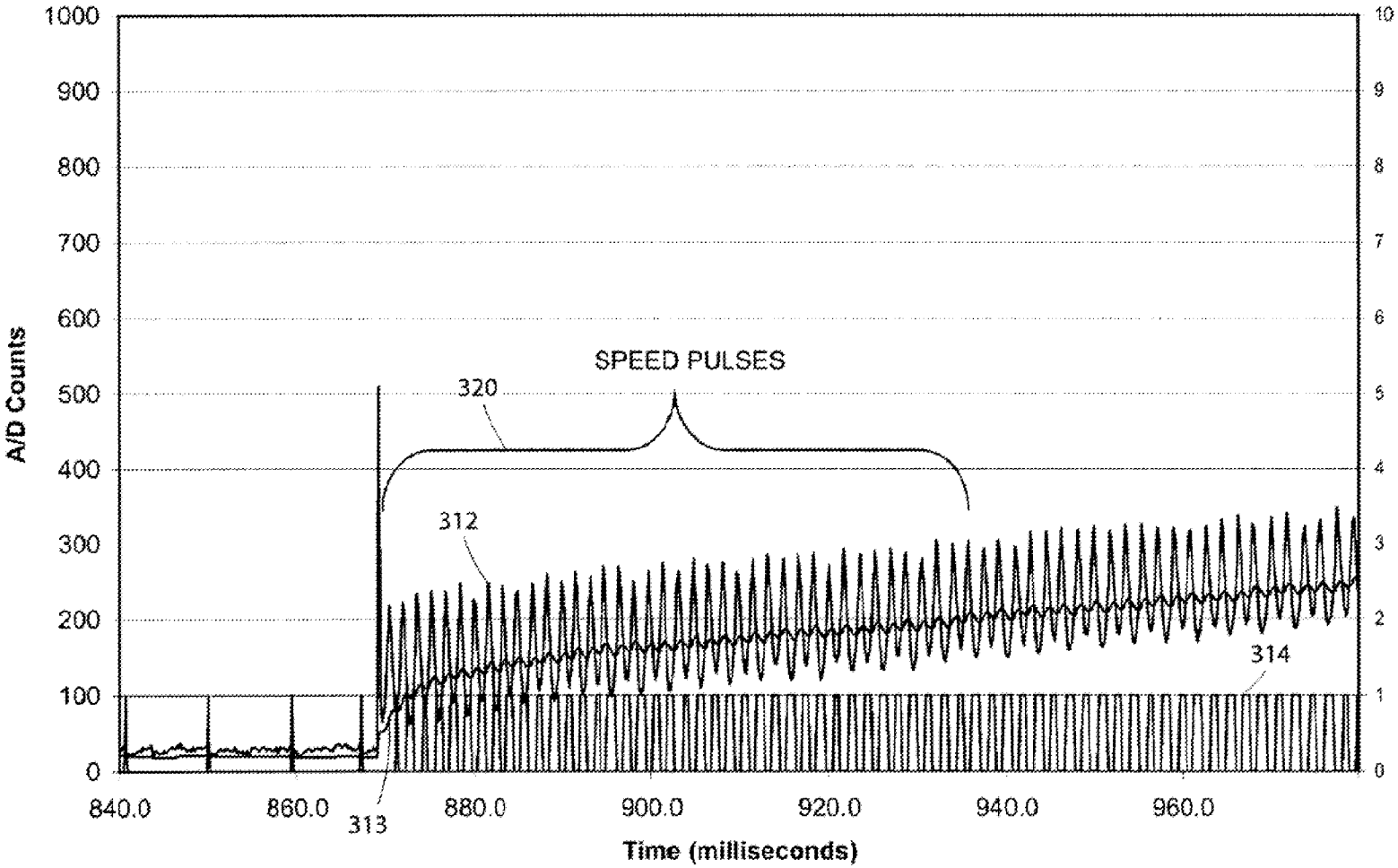

FIGS. 3A, 3B, and 3C illustrate graphs of motor current Im during different motor operating intervals as follows: FIG. 3A illustrates a typical motor operating cycle during which a length of towel is dispensed by dispenser 100; FIG. 3B represents an expanded view of motor current Im during the startup portion of the operating cycle; and FIG. 3C represents an expanded view of motor current Im after motor 120 is deactivated. The data in FIGS. 3A, 3B, and 3C represents the output of A/D converter 205, expressed in counts, over the cycle. In the illustrated embodiments, each count represents approximately 10 ma (milliamperes). However, the scaling of A/D converter 205 and the current levels in motor 120 may vary depending on the particular implementation.

Referring to FIG. 3A, the operating cycle includes a "motor on" interval 300 and a "motor off" interval 305. During a start portion 310 of motor 120 on interval 300, it is evident that motor current Im is at its highest level within "motor on" interval 300, and the pulses are readily discernible. In the illustrated embodiments, motor controller 145 measures pulses by comparing measured motor current Im, represented by the signal 312, to a reference current (Im_REFERENCE), represented by the signal 313 (both shown in FIG. 3B). A pulse is detected, as represented by the signal 314, when measured motor current Im drops below reference current Im_REFERENCE by a predetermined threshold (e.g., 2 counts or 20 ma).

As seen in FIG. 3A, as motor 120 approaches steady state, motor current Im drops, and the magnitude of the pulses also decreases, as indicated by a low pulse signal interval 315. In FIG. 3B, it is evident that the bottom peaks of the motor current pulses approach reference current Im_REFERENCE such that the difference may be less than the threshold. FIG. 3B illustrates a missed pulse 316, during which motor current Im failed to drop sufficiently below reference current Im_REFERENCE.

As described in greater detail below, motor controller 145 may detect low pulse signal interval 315 and use a pulse approximation technique to calculate the pulses that occur during the interval. To implement the approximation, motor controller 145 measures the pulse rate of pulses occurring immediately after motor 120 is turned off, as represented by the speed pulses 320 in FIGS. 3A and 3C. The measured pulse rate is used to approximate the number of pulses that occurred during low pulse signal interval 315.

Returning to FIG. 3A, during "motor off" interval 305, motor 120 and towel roll 105*r* coast until frictional loading causes motor 120 to stop. After motor 120 is disabled, the output of A/D converter 205 drifts up to the 6V power supply voltage (e.g., around 900 A/D counts).

The motor cycle represented by FIGS. 3A, 3B, and 3C depicts a motor that has relatively light loading at steady-state speed and a significant coast period (no braking). This cycle is typical for paper towel dispenser 100 of FIG. 1. Paper roll 105*r* has considerable inertia that results in lower values of motor current Im once roll 105*r* is in motion. Also, for cost reasons, paper towel dispenser 100 is not equipped with a braking device, resulting in an appreciable coast period. In other applications, where motor 120 is sufficiently loaded, motor current Im may not drop significantly, and a low pulse signal interval 315 may not be present. Also, if motor 120 includes a braking device, the length of "motor off" interval 305 may be decreased significantly, since minimal coasting may be present.

Figure 4A:
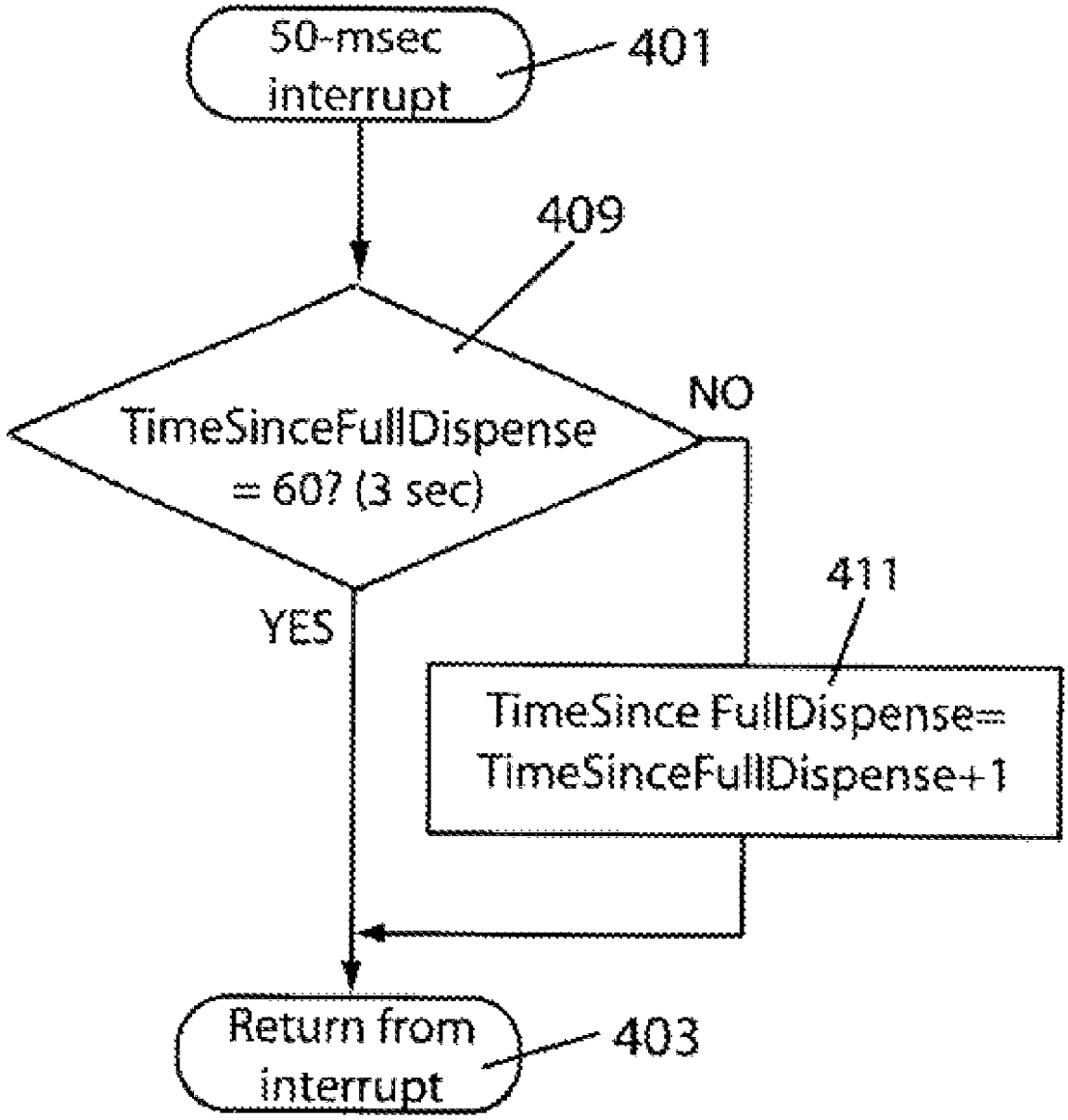
FIGS. 4A, 4B, and 4C are simplified flow diagrams of the general logic implemented by the motor controller to control the motor of FIG. 1.
Figure 4B:
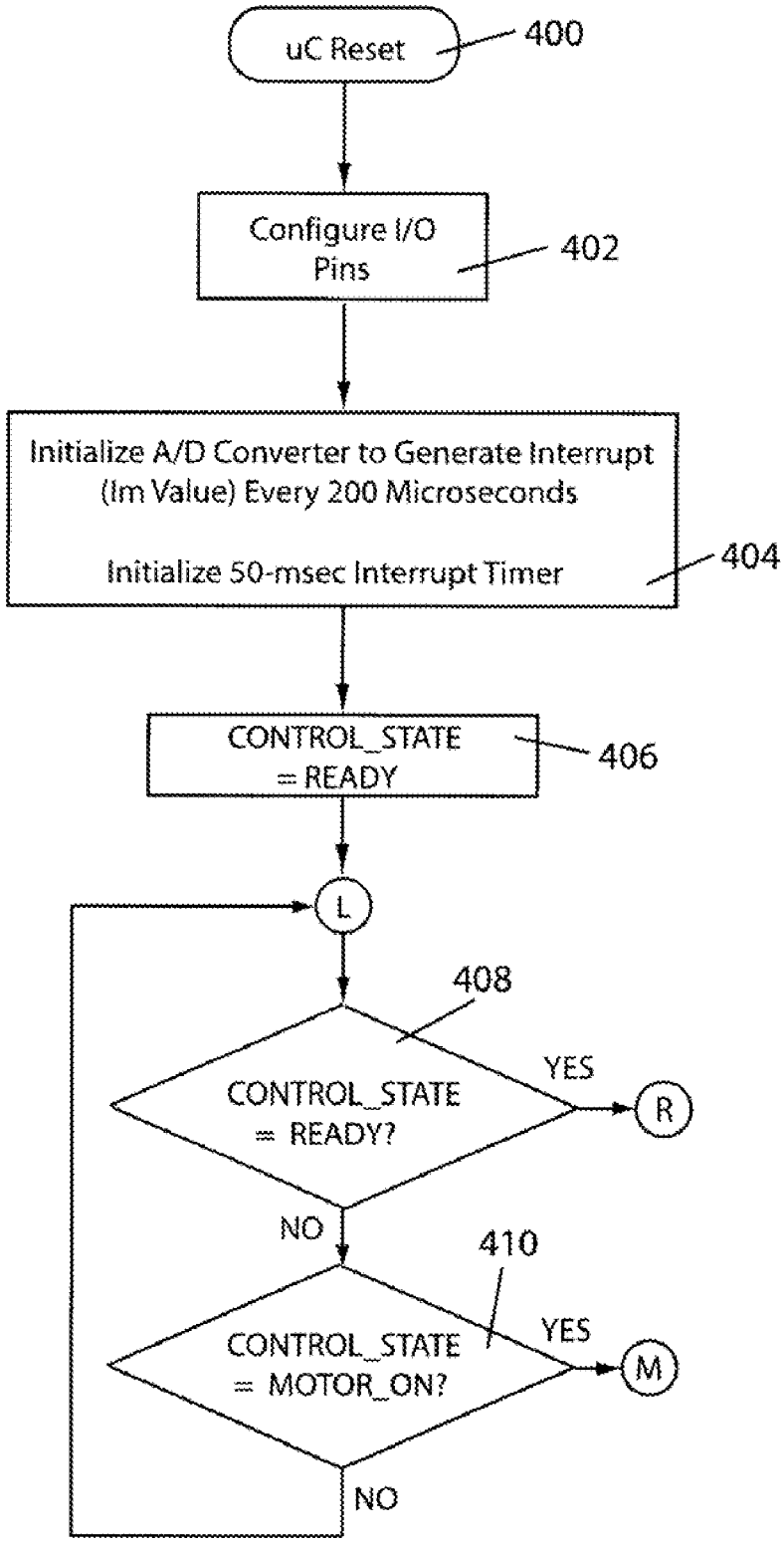
Figure 4C:
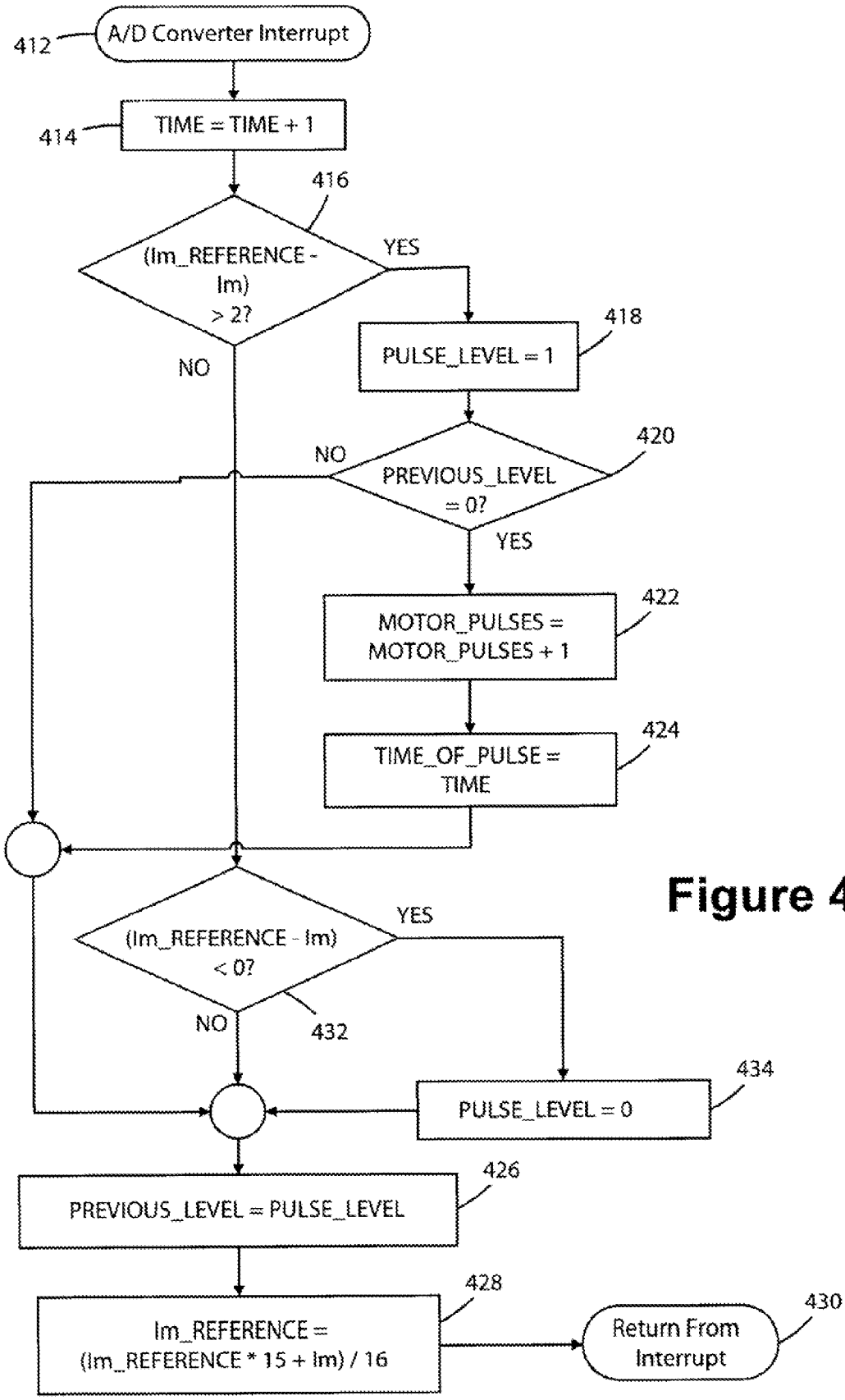

The operation of motor controller 145, in its different embodiments, is now described in detail. FIGS. 4A, 4B, and 4C represent general logic for motor controller 145 that applies to each embodiment further detailed in FIGS. 5A through 7C. Each of these three embodiments illustrates the towel-conserving features of the present invention. Referring first to FIG. 4A, a 50-millisecond (50-msec) interrupt timer operating independently within motor controller 145 generates an interrupt event with a period of 50 msec. In the examples, the 50-msec timer provides an interrupt event which triggers the interrupt logic of FIG. 4A which in turn uses the "preset time" to establish whether such preset time has been reached following the initiation of a full length dispense cycle. After initiation of an initial (full towel length) dispense cycle, a subsequent user request made within the preset time results in dispensing of a partial towel length while a subsequent user request made after the preset time results in dispensing of a full towel length. The preset time in the embodiments described in FIGS. 4A-7C is 3 seconds (60×50 msec) as shown in decision blocks 409, 501, 601, and 701.

Preset time refers to an interval establishing a threshold of time used to determine whether a full or partial length of towel is to be dispensed to the user. In the examples described herein, the value of the preset time is hard-coded within the program of motor controller 145. Alternatively, the preset time could be loaded as a constant during motor controller 145 initialization which occurs in logic block 404 in FIG. 4B. Motor controller 145 could also be configured to allow selection among a set of preset times to be selected by an operator using an appropriate control. Examples of such a control could include switches or jumpers within motor controller 145 circuitry.

During operation, block 401 is entered when a 50-msec interrupt event occurs. In decision block 409, if a variable TimeSinceFullDispense is not equal to the preset time (e.g., 60 counts or 3 seconds), motor controller 145 increments TimeSinceFullDispense by one count. If TimeSinceFullDispense is equal to the preset time (e.g., 60 counts or 3 seconds) in block 409, the variable TimeSinceFullDispense is not incremented. Microcontroller 200 returns from the 50-msec interrupt in block 403.

The combined effect of the 50-msec interrupt timer, decision block 409 and block 411 is to update the time (represented as a counter value TimeSinceFullDispense) since initiation of a "full length" towel dispense cycle as triggered by a user request. As shown in FIG. 4A, the variable TimeSinceFullDispense is a count of 50-msec time periods, and this variable is incremented in block 411 every 50 msec until it reaches a value of 3 seconds (preset time=3 seconds=60×50 msec) in this example. When the variable TimeSinceFullDispense reaches the preset time in counts, it remains at that value until it is reset to 0 in subsequent parts of the logic of motor controller 145.

Referring next to FIG. 4B, block 400 is entered when microcontroller 200 is reset. The I/O pins are configured in block 402, and A/D converter 205 is initialized in block 404 to generate a periodic A/D interrupt (e.g., every 200 microseconds). The 50-millisecond (msec) software-programmed interrupt timer illustrated in FIG. 4A is also initialized in block 404.

A CONTROL_STATE variable is initialized to a READY state in block 406. If CONTROL_STATE is not in a READY state in decision block 408 and not in a MOTOR_ON state in decision block 410, motor controller 145 loops back to a loop marker L. If CONTROL_STATE is not in a READY state in decision block 408 and is in a MOTOR_ON state in decision block 410, motor controller 145 transitions to motor marker M. If the CONTROL_STATE is in a READY state in decision block 408, then motor controller 145 transitions to ready marker R. The subsequent logic at markers R and M are discussed in greater detail below since they depend on the particular embodiment.

Referring now to FIG. 4C, block 412 is entered following an A/D interrupt (according to the interval initialized in block 404). A TIME variable (e.g., a rolling counter) is incremented in block 414. If the difference between the reference current Im_REFERENCE and the motor current Im is less than 2 A/D counts (e.g., approximately 20 ma in the illustrated embodiment) in decision block 416, a pulse is detected. Of course, other detection thresholds or equations may be used depending on the particular characteristics of the system employed. After detecting a pulse in decision block 416, a PULSE_LEVEL variable is set to 1 in block 418. If a PREVIOUS_LEVEL variable equals 0 in decision block 420 indicating that this is the first detection for the current pulse, a MOTOR_PULSES variable is incremented in block 422, and a TIME_OF_PULSE variable is set to the current TIME in block 424. The PREVIOUS PULSE variable is set to the PULSE_LEVEL in block 426, and the Im_REFERENCE value for the next iteration is calculated in block 428 using the low pass filter equation Im_REFERENCE=(Im_REFERENCE*15+Im)/16. Of course, other equations, such as other averaging equations, may be used to generate the Im_REFERENCE value for the next iteration. Microcontroller 200 returns from the A/D interrupt in block 430.

The interrupt frequency of the A/D converter 205 should be set such that a given pulse spans numerous interrupts (i.e., to avoid missing pulses). If the PREVIOUS_LEVEL equals 1 in block 420, indicating that the current pulse has already been detected, the motor controller 145 transitions to block 426 and continues as described above to complete the interrupt.

If the pulse is not detected in decision block 416, motor controller 145 determines if the difference between Im_REFERENCE and motor current Im is less than 0 in decision block 432 (i.e., representing motor current Im rising back above the reference current Im_REFERENCE after the downward spike and the end of the pulse). If the end of the pulse is detected in decision block 432, the PULSE_LEVEL is set back to 0 in block 434, and motor controller 145 continues in block 426 to complete the interrupt.

Figure 5A:
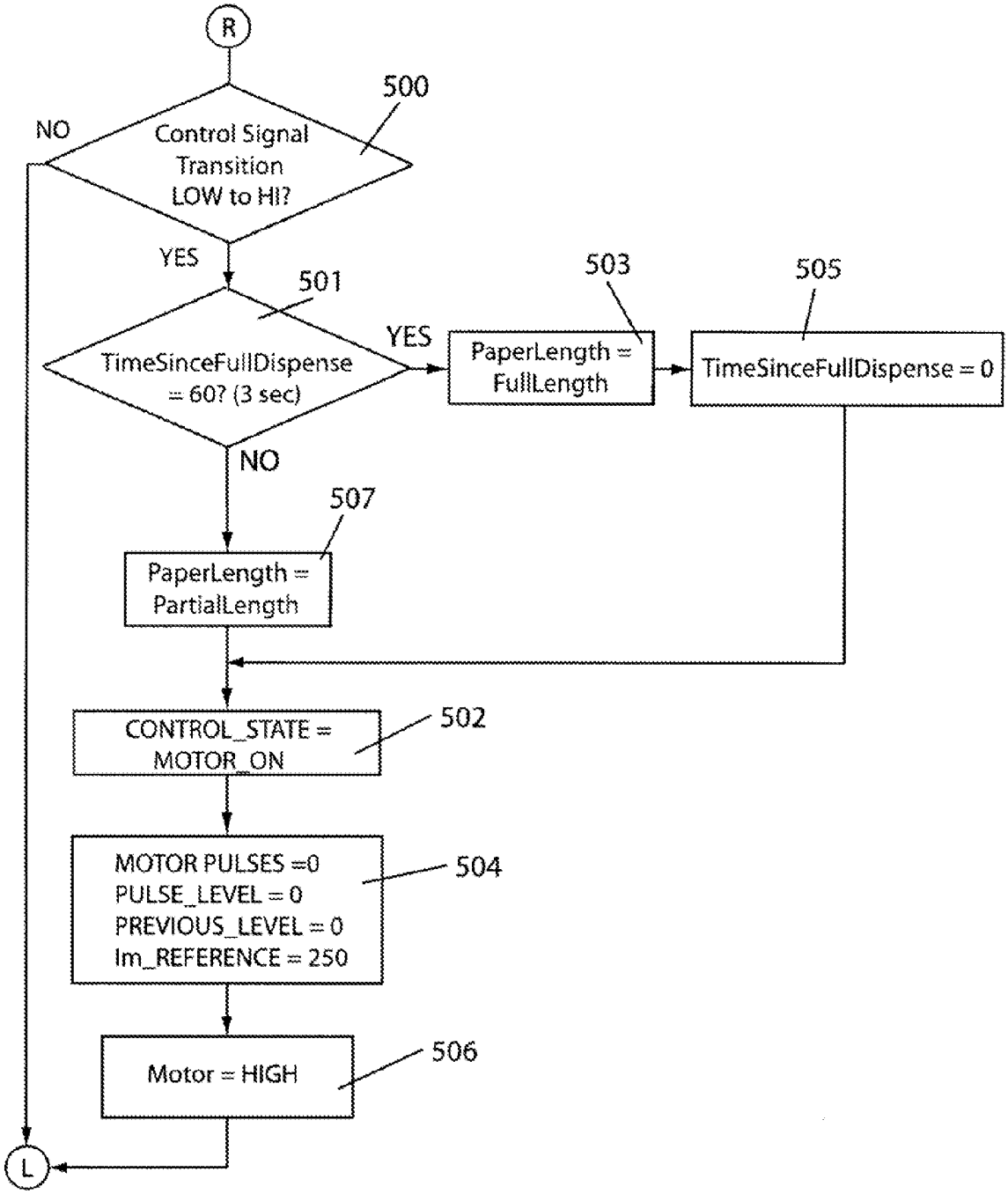
FIGS. 5A and 5B are simplified flow diagrams of the logic implemented by the motor controller to control the motor in accordance with a first embodiment based on pulse counts while the motor is operating.
Figure 5B:
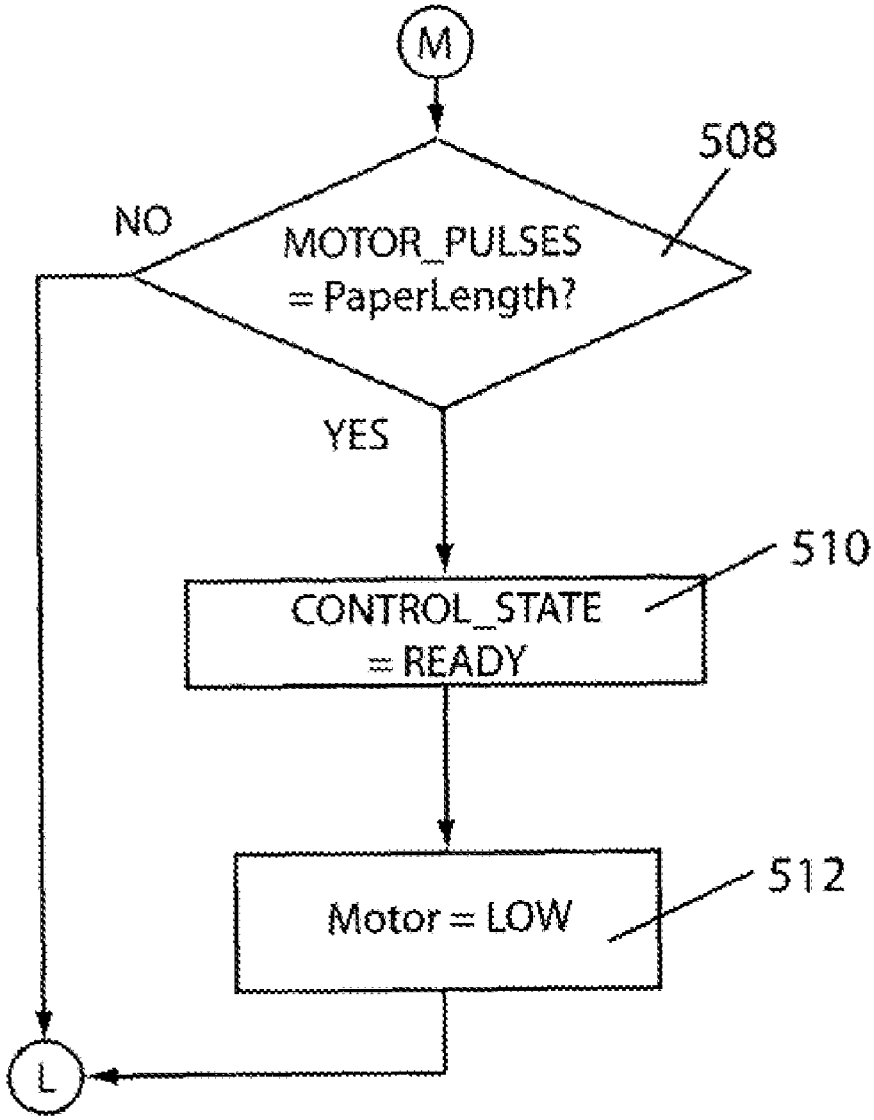

In a first embodiment, detailed in FIGS. 5A and 5B, motor controller 145 is configured to control motor 120 without a significant coasting period. Hence, the motor pulses are only counted during "motor on" interval 300 of FIG. 3A. FIG. 5A represents the logic implemented by motor controller 145 in the READY state of FIG. 4B at marker R, and FIG. 5B represents the logic implemented in the MOTOR_ON state at marker M.

In decision block 500, motor controller 145 detects a transition of the control signal provided by proximity sensor 150 of FIG. 1 indicating that a user request has been made and that an activation of paper towel dispenser 100 is desired. If no control signal is detected, motor controller 145 transitions back to loop marker L.

After detection of the control signal corresponding to the user request, decision block 501 determines whether the user request has been made within or after the preset time which, in the examples, is 3 seconds. In block 501, if the variable TimeSinceFullDispense is equal to the preset time of 3 seconds (60 counts) then a variable PaperLength is set to a value FullLength in block 503 and the variable TimeSinceFullDispense is reset to 0 in block 505. A value of 3 seconds (60 counts) for TimeSinceFullDispense indicates that at least 3 seconds have elapsed (at least 60 counts have occurred) since the preceding full-length dispense cycle by virtue of the fact that the variable TimeSinceFullDispense is not incremented past this value of 60 counts.

In a typical embodiment, FullLength has a value of around 480 pulses and this value represents the number of pulses required to deliver a full length of towel of approximately 12 inches. Of course, this number is dependent on numerous particular specifications of motor 120, any gearing employed such as gear 130, and the dimensions of rollers 115*a* and 115*b* used to drive towel 105 during a dispense cycle. If, for example, 480 pulses are required to deliver a 12-inch length of towel, then any other length is linearly related to this value. Thus an 6-inch towel would require a value of 240 for the variable PaperLength.

At decision block 501, if TimeSinceFullDispense is not equal to the preset time, then the variable PaperLength is set at a value PartialLength in block 507. The PartialLength setting may be, for example, 240 pulses which represents the number of pulses needed to dispense a 6 inch length of towel from the dispenser. Any length less than the full length represents a partial length. A TimeSinceFullDispense value of less than the preset 3 seconds of this example would indicate that less than 3 seconds has elapsed since initiation of the preceding full dispense cycle. In the examples, a time interval less than the preset time is referred to herein as being within the preset time while a time interval equal to the preset time is referred to herein as being after the preset time. In the exemplary embodiments, the value of the preset time in blocks 501, 601 and 701 is 3 seconds. Other arrangements are possible.

After either setting PaperLength to FullLength or PartialLength, motor controller 145 proceeds to change the CONTROL_STATE to MOTOR_ON in block 602. In block 604, the MOTOR_PULSES, PULSE_LEVEL, and PREVIOUS_LEVEL variables are initialized to zero, and the Im_REF- ERENCE variable is initialized to 250. The initialization value for Im_REFERENCE may vary depending on the particular implementation. Motor activation output terminal 215 of FIG. 2 is set at a logic high state in block 506 to activate transistor 210 and start motor 120. Motor controller 145 then transitions back to loop marker L.

On the next iteration, the CONTROL_STATE will be MOTOR_ON in block 410 of FIG. 4B, and motor controller 145 transitions to MOTOR_ON marker M, detailed in FIG. 5B. In decision block 508, motor controller 145 determines if the number of MOTOR_PULSES equals PaperLength (the required number of pulses for a complete motor cycle dispensing either the full or partial length of towel). If the required number of pulses (PaperLength) has not been counted, motor controller 145 transitions back to loop marker L and motor 120 continues to operate. If the required number of pulses (PaperLength) has been counted, the CONTROL_STATE is set back to READY in block 510, and motor 120 is turned off in block 512 by deasserting the signal (i.e., setting to a logic low state) at activation output terminal 215 to turn off transistor 210. Motor controller 145 then returns to loop marker L on FIG. 4B to await another activation. The result is that the dispenser provides the user with either a partial length of towel or a full length of towel based on whether the user request occurred within or after the preset time.

Figure 6A:
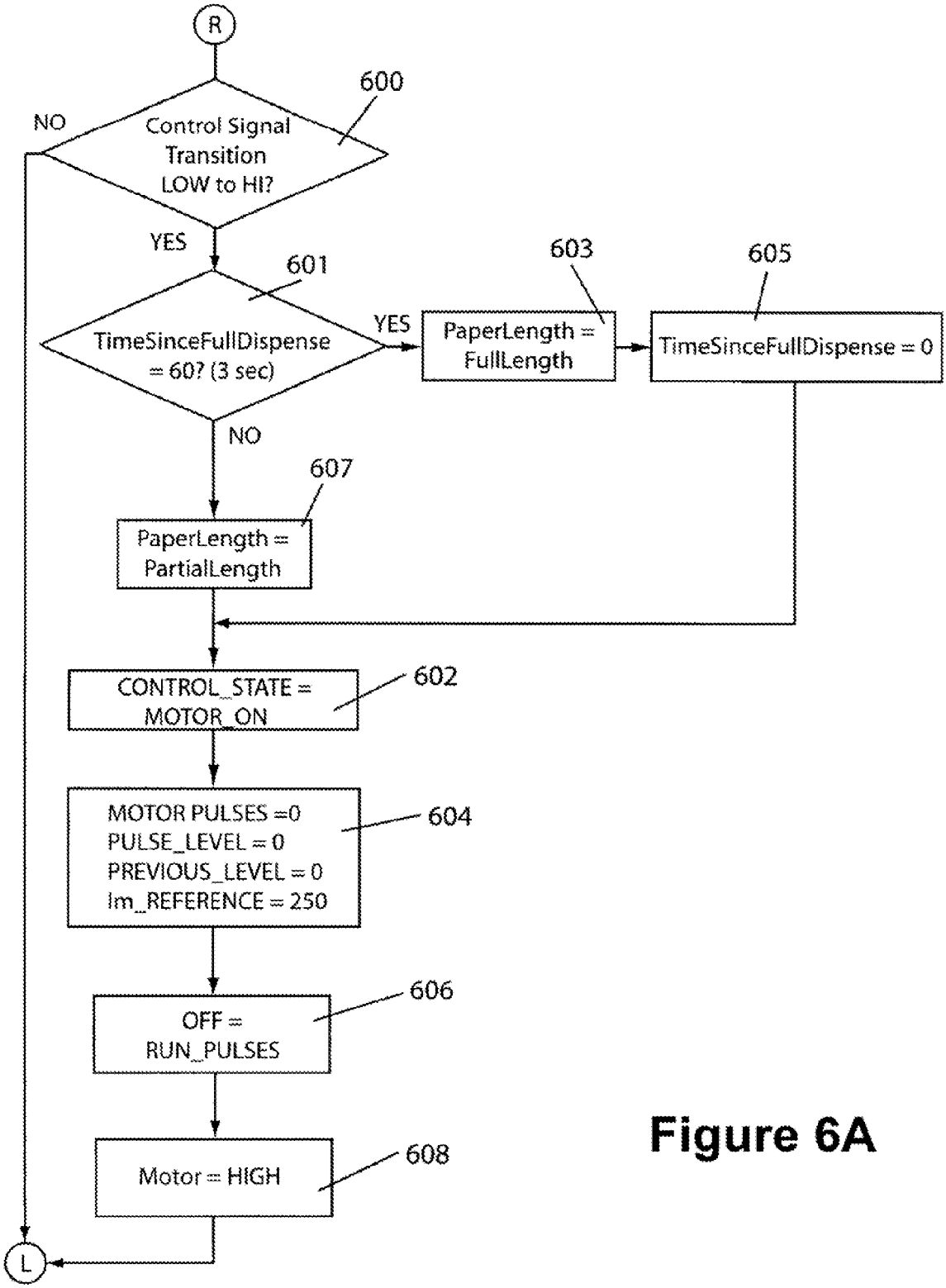
FIGS. 6A and 6B are simplified flow diagrams of the logic implemented by the motor controller to control the motor in accordance with a second embodiment based on pulse counts while the motor is operating and pulse counts while the motor is coasting after motor deactivation.
Figure 6B:
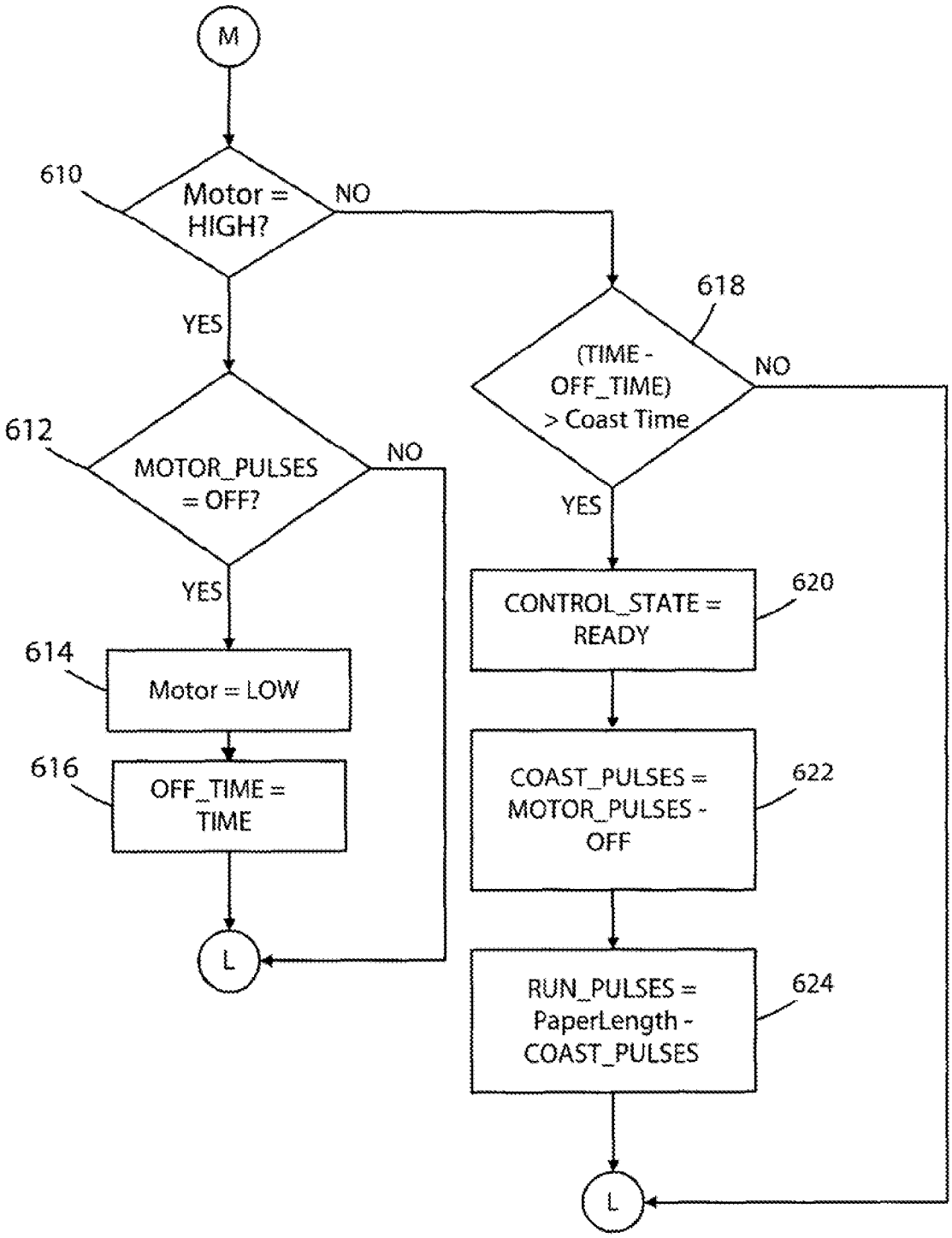

In a second embodiment, detailed in FIGS. 6A and 6B, motor controller 145 is configured to control a motor 120 with an appreciable coasting period. Hence, the motor pulses are counted during "motor on" interval 300 of FIG. 3A and during "motor off" interval 305 while motor 120 is coasting.

FIG. 6A represents the logic implemented by motor controller 145 in the READY state of FIG. 4B at marker R, and FIG. 6B represents the logic implemented in the MOTOR_ON state at marker M.

In decision block 600, motor controller 145 detects a transition of the control signal provided by proximity sensor 150 of FIG. 1 indicating that a user request has been made and that an activation of paper towel dispenser 100 is desired. If no control signal is detected, motor controller 145 transitions back to loop marker L.

After detection of the control signal corresponding to the user request, decision block 601 determines whether the user request has been made within or after the exemplary preset time of 3 seconds since the preceding full dispense cycle. If TimeSinceFullDispense is equal to the 3 second preset time (i.e, after the preset time), then a variable PaperLength is set a value FullLength in block 603 and the variable TimeSinceFullDispense is reset to 0 in block 605. This decision indicates that 3 or more seconds have elapsed since initiation of the preceding full towel length dispense cycle. At decision block 601, if the TimeSinceFullDispense variable is not equal to the preset time, then the variable PaperLength is set to a value PartialLength in block 607. This decision indicates that less than 3 seconds have elapsed since initiation of the preceding full towel length dispense cycle. The values FullLength and PartialLength are the same as those discussed in the first embodiment described above.

After either setting PaperLength to FullLength or PartialLength, motor controller 145 proceeds to change the CONTROL_STATE to MOTOR_ON in block 602. In block 604, the MOTOR_PULSES, PULSE_LEVEL, and PREVIOUS_LEVEL variables are initialized to zero, and the Im_REFERENCE variable is initialized to 250. The initialization value for Im_REFERENCE may vary depending on the particular implementation. An OFF variable is set to the current value of a RUN_PULSES variable in block 606. In general, the OFF variable represents the number of pulses that motor controller 145 counts during "motor on" interval 300 prior to turning motor 120 off. The RUN_PULSES variable is a feedback variable that is set from a previous iteration that is adjusted based on the total number of pulses counted during the "motor off" interval 305, as will become evident later in the logic flow. Motor activation output terminal 215 of FIG. 2 is set at a logic high state in block 608 to activate transistor 210 and start motor 120. Motor controller 145 then transitions back to the loop marker L.

On the next iteration, the CONTROL_STATE will be MOTOR_ON in block 410 of FIG. 4B, and motor controller 145 transitions to the MOTOR_ON marker M, detailed in FIG. 6B. In decision block 610, motor controller 145 determines if motor 120 is on. If motor 120 is on, motor controller 145 determines if the counted MOTOR_PULSES is equal to the value of the OFF variable (i.e., initialized in block 606) in decision block 612. If the required number of pulses has not been counted, motor controller 145 transitions back to loop marker L and motor 120 continues to operate. If the required number of pulses during "motor on" interval 300 of FIG. 3A has been counted, motor 120 is turned off in block 614 by deasserting the signal at the activation output terminal 215 to turn off the transistor 210. An OFF_TIME variable is set to the current value of the TIME counter in block 616, and motor controller 145 then returns to loop marker L on FIG. 4B.

On the next iteration, the CONTROL_STATE is still MOTOR_ON, but the motor is off in block 610. In decision block 618, motor controller 145 determines the time that motor 120 has been coasting by subtracting the OFF_TIME from the current TIME and comparing that time to a Coast_Time variable. The Coast_Time variable is a predetermined constant that is set depending on the expected coast time of the motor, as illustrated by "motor off" interval 305 in FIG. 3A.

If the predetermined coast time has been reached in decision block 618, the CONTROL_STATE is returned to READY in block 620. The number of COAST_PULSES is calculated in block 622 by subtracting the value of the OFF variable from the total MOTOR_PULSES. In block 624, the value for RUN_PULSES is updated by subtracting the number of COAST_PULSES from PaperLength (the total number of required pulses to dispense the desired length of towel as set in the logic described in FIG. 6A). Hence, if the coasting characteristics of motor 120 change over time, the number of pulses that are counted during "motor on" interval 300 are adjusted to compensate such that the total number of pulses remains close to variable PaperLength. Motor controller 145 transitions back to loop marker L on FIG. 4B to await another activation.

Figure 7A:
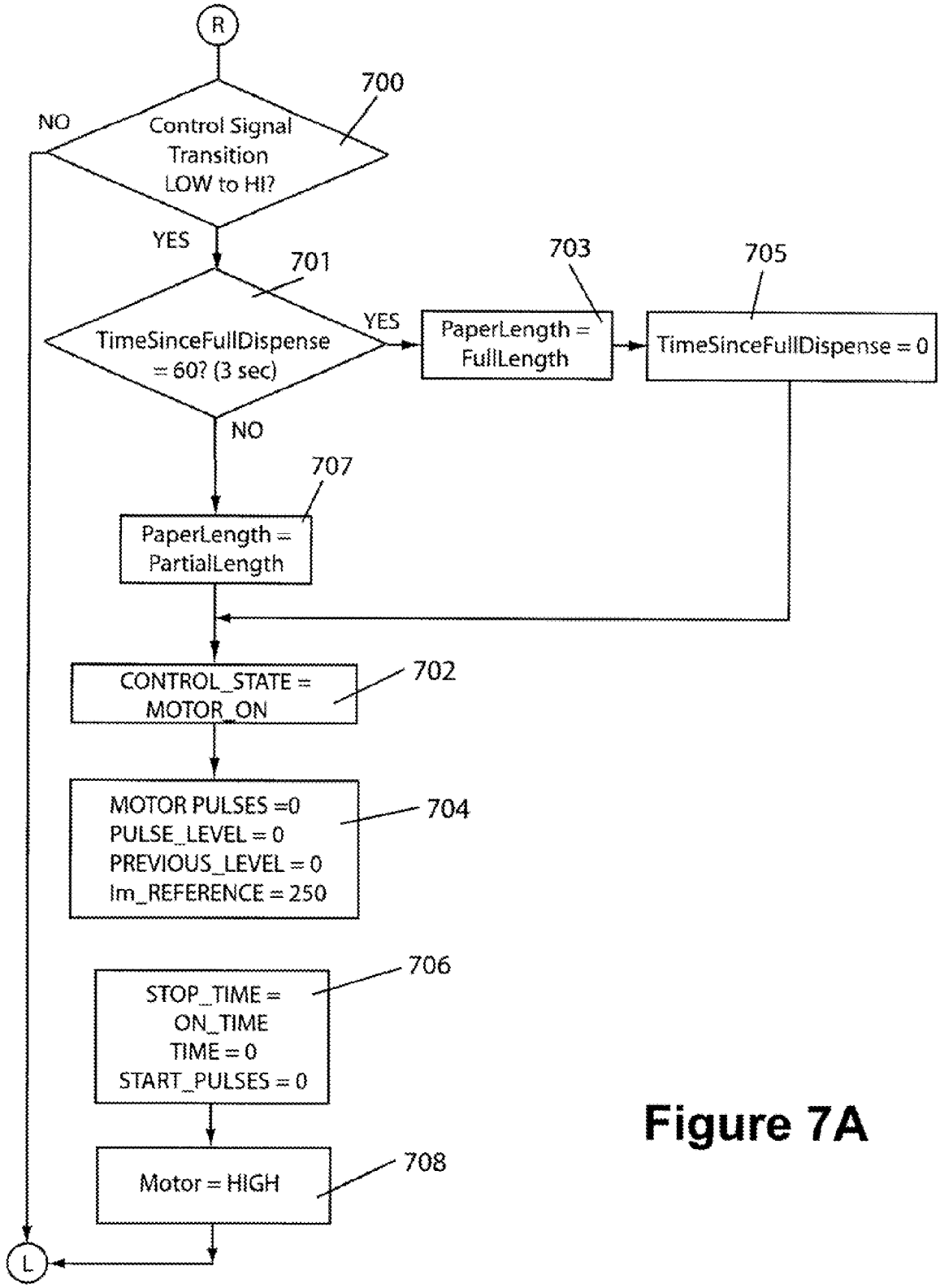
FIGS. 7A, 7B, and 7C are simplified flow diagrams of the logic implemented by the motor controller to control the motor in accordance with a third embodiment based on pulse counts while the motor is operating, pulse counts while the motor is coasting after motor deactivation, and estimated pulse counts occurring during a period of low motor current.
Figure 7B:
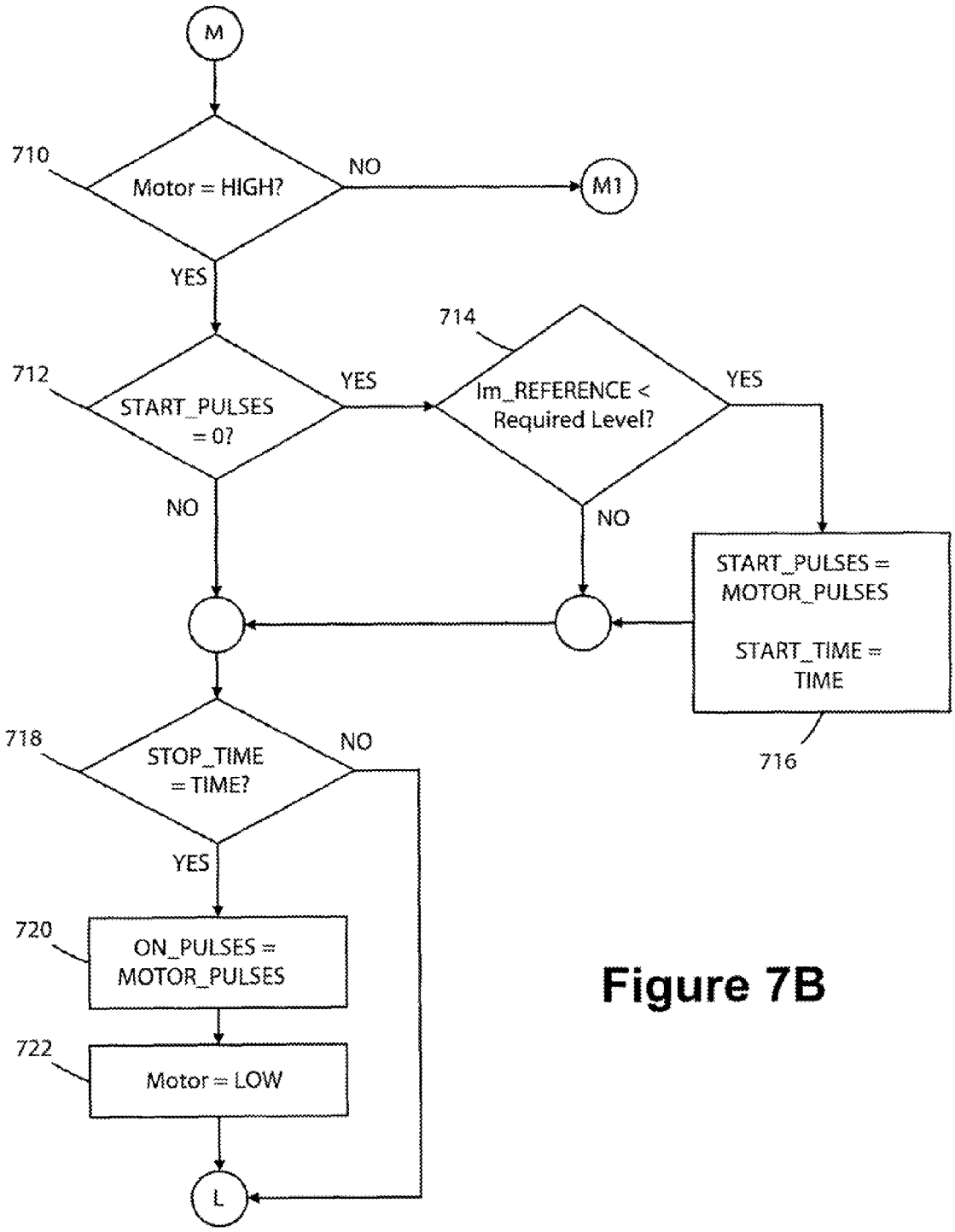
Figure 7C:
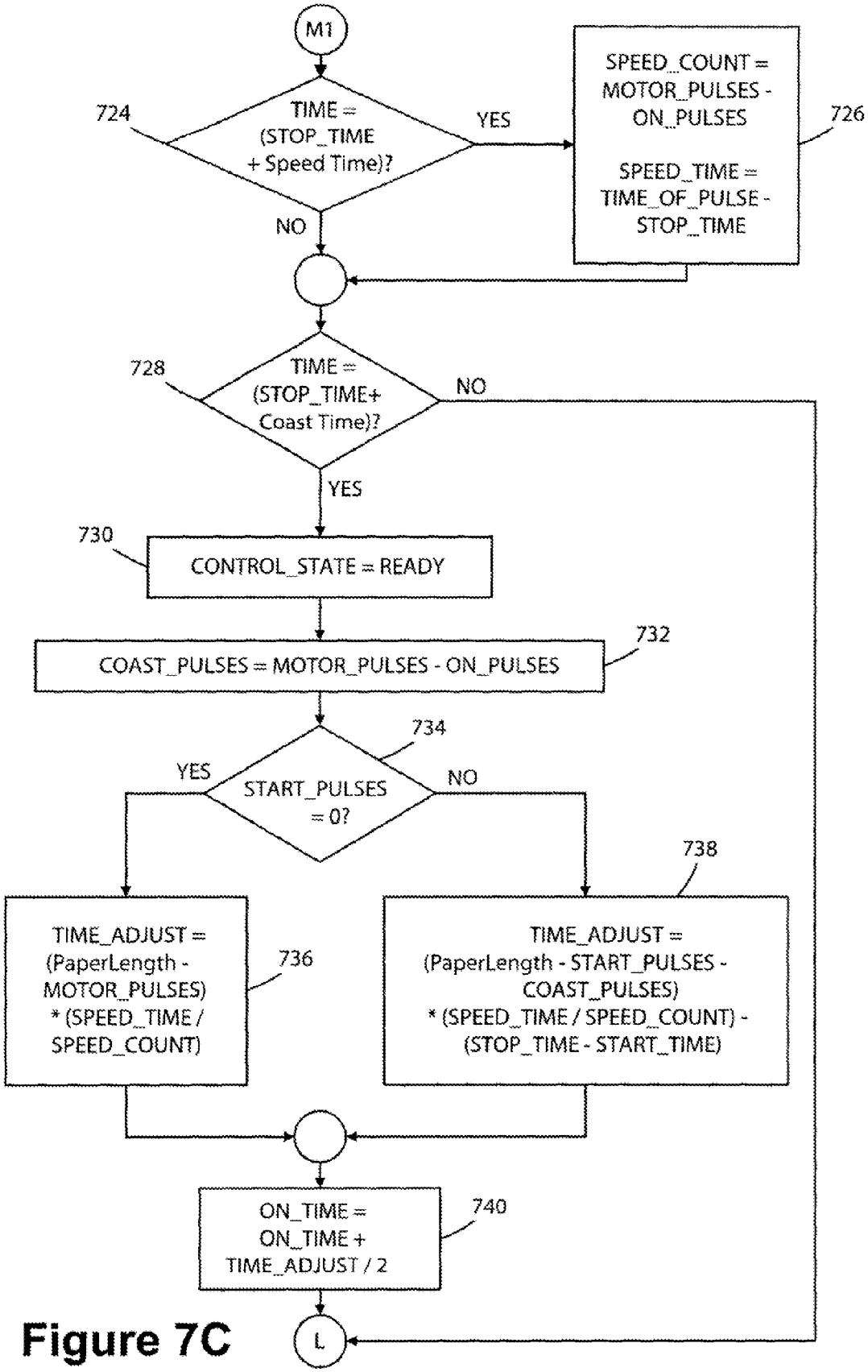

In a third embodiment, detailed in FIGS. 7A, 7B, and 7C, motor controller 145 is configured to control a motor 120 with an appreciable coasting period and a period where motor current Im drops to a level where it is difficult to detect pulses (e.g., at steady state). Hence, the motor pulses are counted during at least a portion of "motor on" interval 300 of FIG. 3A and during "motor off" interval 305 while the motor is coasting. The speed pulses 320 are counted to determine a motor pulse rate for the immediately previous low pulse signal interval 315 to approximate the pulses that occurred therein. FIG. 7A represents the logic implemented by motor controller 145 in the READY state of FIG. 4B at marker R, and FIGS. 7B and 7C represent the logic implemented in the MOTOR_ON state at marker M.

In decision block 700, the motor controller 145 detects a transition of the control signal provided by proximity sensor 150 of FIG. 1 indicating that a user request has been made and that an activation of paper towel dispenser 100 is desired. If no control signal is detected, motor controller 145 transitions back to loop marker L. After detection of the control signal, decision block 701 determines if the variable TimeSinceFullDispense is equal to the preset time of 3 seconds. If TimeSinceFullDispense is equal to the preset time (i.e, 3 seconds in these example embodiments), then a variable PaperLength is set a value FullLength in block 703 and the variable TimeSinceFullDispense is reset to 0 in block 705. As with the preceding examples, this represents a user request occurring after the preset time. At decision block 701, if TimeSinceFullDispense is not equal to the preset time (i.e., within the preset time), then the variable PaperLength is set at a value PartialLength in block 707. The values FullLength and PartialLength are the same as those discussed in the first embodiment described above.

After either setting PaperLength to FullLength or PartialLength, motor controller 145 proceeds to change the CONTROL_STATE to MOTOR_ON in block 702. In block 704, the MOTOR_PULSES, PULSE_LEVEL, and PREVIOUS_LEVEL variables are initialized to zero, and the Im_REFERENCE variable is initialized to 250. The initialization value for Im_REFERENCE may vary depending on the particular implementation.

In block 706, a STOP_TIME variable is set to the current value of an ON_TIME variable, the TIME counter is set to zero, and a START_PULSES variable is set to 0. The STOP_TIME variable represents the time included in "motor on" interval 300 of FIG. 3A. As detailed below, the STOP_TIME is adjusted as feedback is collected regarding the number of coast pulses and pulses occurring during the low pulse signal interval 315. The initial value of the STOP_TIME variable (prior to any iterations) may be set during microcontroller 200 reset based on the expected characteristics of the particular implementation. Motor activation output terminal 215 of FIG. 2 is set at a logic high state in block 708 to activate transistor 210 and start motor 120. Motor controller 145 then transitions back to loop marker L.

On the next iteration, the CONTROL_STATE will be MOTOR_ON in block 410 of FIG. 4B, and motor controller 145 transitions to MOTOR_ON marker M, detailed in FIG. 7B. In decision block 710, motor controller 145 determines if motor 120 is on. If motor 120 is on, motor controller 145 determines if the variable START_PULSES equals its initialized value of zero in decision block 712 (i.e., a low pulse signal interval has not been detected). If the START_PULSES value is zero in decision block 712, the Im_REFERENCE value is compared to a Required Level threshold value (e.g., 67 counts or 0.67 amps in the illustrated embodiment) in decision block 714. If the Im_REFERENCE value is less than the threshold, motor controller 145 sets the START_PULSES variable to the number of counted MOTOR_PULSES and sets the START_TIME to the current TIME in block 716.

After completing either decision block 712 or block 716, motor controller 145 determines if the STOP_TIME equals the current TIME in decision block 718. If the STOP_TIME has not been reached, motor controller 145 returns to loop marker L. If the STOP_TIME has been reached, the variable ON_PULSES is set to the total number of counted MOTOR_PULSES in block 720 and motor 120 is turned off in block 722 by deasserting the signal at activation output terminal 215 to turn off transistor 210.

Returning back to decision block 710, if the motor is off (i.e., coasting), motor controller 145 transitions to marker M1 shown in FIG. 7C. After motor 120 is turned off, motor controller 145 counts speed pulses 320 in FIG. 3A to approximate the speed of motor 120 during low pulse signal interval 315. In decision block 724, the current TIME is compared to the STOP_TIME that motor 120 was turned off plus the Speed Time, a predetermined time interval for counting pulses after motor 120 is turned off. If the Stop Time has elapsed, the variable SPEED_COUNT is calculated in block 726 by subtracting the ON_PULSES from the total number of MOTOR_PULSES, and the SPEED_TIME is calculated by subtracting the STOP_TIME from the time of the last pulse, TIME_OF_PULSE.

After completing either decision block 724 or block 726, motor controller 145 determines if the coast time has elapsed in decision block 728 by comparing the current TIME to the STOP_TIME plus the predetermined Coast Time. If the coast time has not elapsed, motor controller 145 returns to loop marker L. If the coast time has elapsed, the CONTROL_STATE is returned to READY in block 730. The number of COAST_PULSES is determined by subtracting the ON_PULSES from the total MOTOR_PULSES in block 732. Motor controller 145 determines if no START_PULSES were determined in decision block 734. If START_PULSES still equals its initialization value of zero, low pulse signal interval 315 was never entered, and motor controller 145 was able to count all of the pulses during "motor on" interval 300. If the START_PULSES equals zero, motor controller 145 determines a time adjustment factor in block 736 based on the calculated speed and the counted motor pulses using the equation TIME_ADJUST=(PaperLength−MOTOR_PULSES)*(SPEED_TIME/SPEED_COUNT). The difference between the PaperLength and the counted MOTOR_PULSES represents a pulse error. Multiplying the pulse error by the inverse of the pulse rate determined by counting the speed pulses 320 yields a time adjustment. If too many pulses are counted, the time adjustment factor will be negative, and the ON_TIME of the motor will be decreased. Similarly, if too few pulses are counted, the time adjustment factor will be positive, and the on time of the motor will be increased.

If the number of START_PULSES does not equal zero (i.e., a low pulse signal interval 315 was detected), motor controller 145 determines a time adjustment factor in block 738 based on the calculated speed and the counted motor pulses using the equation TIME_ADJUST=(PaperLength−START_PULSES−COAST_PULSES)*(SPEED_TIME/SPEED_COUNT)−(STOP_TIME−START_TIME). Subtracting the START_PULSES and the COAST_PULSES from the PaperLength yields the desired number of pulses for low pulse signal interval 315. Multiplying the desired number of pulses by the inverse of the pulse rate calculated using the speed pulses 320 yields a calculated time that should have elapsed during the low pulse signal interval 315. The actual time that occurred in low pulse signal interval 315 is subtracted from the calculated time to generate the time adjustment factor. Hence, if motor 120 is coasting faster than previously determined based on the pulse rate calculated from the speed pulses 320, the difference between the calculated time and the actual time in block 738 will be negative and the ON_TIME of motor 120 will be decreased.

The equation of block 738 is mathematically equivalent to calculating the number of pulses that occurred in low pulse signal interval 315 based on the determined pulse rate, subtracting the Coast Pulses and the pulses counted during the "motor on" interval 300 prior to the low pulse signal interval 315 from the PaperLength to get a pulse error, and dividing the pulse error by the calculated pulse rate to generate the time adjustment factor. That is, the equation may be rewritten as:

TIME_ADJUST=(PaperLength−START_PULSES−COAST_PULSES−(STOP_TIME−START_TIME)* (SPEED_COUNT/SPEED_TIME))/(SPEED_COUNT/SPEED_TIME).

After calculating the TIME_ADJUST in either block 736 or block 738, the ON_TIME is adjusted by adding half of the TIME_ADJUST value to the current ON_TIME in block 740, and motor controller 145 transitions back to loop marker L. In this third illustrated embodiment, only half of the adjustment is used to update the ON_TIME to avoid overcompensation. Of course, a different adjustment function may be employed depending on the particular implementation.

Motor controller 145 described herein has numerous advantages. Because motor controller 145 is implemented using software-controlled microcontroller 200, it can be easily configured to accommodate a wide variety of motor applications. If motor 120 does not exhibit an appreciable coast time, motor controller 145 may be configured to implement the embodiment of FIGS. 5A and 5B. If motor 120 has a coast period but is sufficiently loaded such that motor current Im does not drop below a level suitable for detecting pulses, motor controller 145 may be configured to implement the embodiment of FIGS. 6A and 6B. Finally, if motor 120 does have a coast period and potential low pulse signal intervals, motor controller 145 may be configured to implement the embodiment of FIGS. 7A, 7B, and 7C.

According to the foregoing logic, it is assumed that user requests occurring 3 seconds or more apart likely represent requests from different users. A user request occurring within 3 seconds after initiation of a dispense cycle in which a full length of towel is dispensed likely represents user requests from a single user. Again, selection of a 3-second preset time is arbitrary and any time increment could be utilized. It is further assumed that the needs of a single user can be met with less than two full sheets of towel.

The logic controls the operation of dispenser 100 so that the different users represented by the user requests made 3 seconds or more apart are each provided with a full length of towel, thereby meeting each user's needs. Motor controller 145 controls electrical power to motor 120 so that the motor is on for the number of counted and/or calculated pulses required to dispense the full length of towel (e.g., 480 pulses).

And, the logic controls the operation of dispenser 100 so that the single user can, if necessary, conveniently obtain a partial length of towel after the initial full length of towel is dispensed. In this situation, motor controller 145 controls electrical power to motor 120 so that the motor is on for the number of counted and/or calculated pulses required to dispense the partial length of towel (e.g., 240 pulses). The number of pulses for the partial length of towel is fewer than the number of pulses required to dispense the full length of towel.

The difference between the partial length of towel dispensed and the full length of towel that would have been dispensed without the control as described herein represents towel that is conserved for use by another user. Conservation of towel is environmentally desirable and reduces the cost of dispenser operation over the lifetime of the dispenser.

The particular embodiments disclosed above are illustrative only; the invention may be modified and practiced in different but equivalent manners apparent to those skilled in the art having the benefit of the teachings herein. Furthermore, no limitations are intended to the details of construction or design herein shown other than as described in the claims below. It is therefore evident that the particular embodiments disclosed above may be altered or modified and all such variations are considered within the scope and spirit of the invention. Accordingly, the protection sought herein is as set forth in the claims below.

The subject matter claimed is:

1. A method for controlling operation of an automatic towel dispenser to conserve the overall amount of towel dispensed comprising:

dispensing from the dispenser a full length of towel responsive to a first user request;

if a further user request occurs within a preset time, dispensing from the dispenser a partial length of towel; and if the further user request occurs after the preset time, dispensing from the dispenser a full length of towel, whereby the difference between the partial length of towel actually dispensed and the full length of towel represents conserved towel.

2. The method of claim 1 wherein the full length of towel is about 8 to 12 inches in length and the partial length of towel is about 4 to 6 inches in length.

3. The method of claim 2 wherein the preset time is about three seconds.

4. The method of claim 3 wherein the preset time is reckoned from the first user request.

5. The method of claim 2 further comprising detecting the user requests with a proximity detector.

6. The method of claim 1 wherein a plurality of further user requests occur within the preset time and the method further comprises dispensing from the dispenser a partial length of towel responsive to each of the plural further user requests.

7. An automatic towel dispenser comprising:

a housing adapted to receive a roll of towel;

an electrically-powered dispensing mechanism adapted to dispense the towel from the dispenser; and a controller operable to control the dispensing mechanism to:

dispense a full length of towel responsive to a first user request;

dispense a partial length of towel responsive to a further user request if the further user request is made within a preset time; and dispense a full length of towel responsive to the further user request if the further user request is made after the preset time, whereby the dispenser conserves the towel dispensed by limiting the length of towel dispensed responsive to a user request made within the preset time.

8. The dispenser of claim 7 wherein the controller comprises a processor, a memory and a set of instructions programmed to control the dispensing mechanism.

9. The dispenser of claim 8 wherein the instructions are adapted to:

control the dispensing mechanism to dispense the full length of towel;

determine whether the further user request is made within the preset time; and control the dispensing mechanism to dispense the partial length of towel if the further user request is made within the preset time and to dispense the full length of towel if the further user request is made after the preset time.

10. The dispenser of claim 9 wherein the instructions reckon the preset time from the first user request.

11. The dispenser of claim 10 wherein the preset time is about three seconds.

12. The dispenser of claim 7 wherein the full length of towel is about 8 to 12 inches in length and the partial length of towel is about 4 to 6 inches in length.

13. The dispenser of claim 7 wherein the dispensing mechanism comprises:

a drive roller;

a motor in power-transmission relationship with the drive roller;

a tension roller positioned against the drive roller to form a nip therebetween, the towel being drawn through the nip and out of the dispenser by powering of the drive roller; and the controller controls electrical power to the motor.

14. The dispenser of claim 13 further comprising a battery power source operable to supply the electrical power to the motor.

15. A towel dispenser comprising:

a dispenser housing adapted to receive a roll of towel;

an electrically-powered dispensing mechanism adapted to dispense the towel from the dispenser; and a processing device programmed with instructions that, when executed, perform a method for dispensing the towel from the dispenser to conserve an overall length of towel dispensed from the dispenser, the method comprising:

operating the dispensing mechanism to dispense a full length of towel responsive to a first user request;

if a further user request occurs within a preset time, operating the dispensing mechanism to dispense a partial length of towel; and if the further user request occurs after the preset time, operating the dispensing mechanism to dispense a full length of towel.

16. The dispenser of claim 15 wherein the full length of towel is about 8 to 12 inches in length and the partial length of towel is about 4 to 6 inches in length.

17. The dispenser of claim 15 wherein the processing device reckons the preset time from the first user request.

18. The dispenser of claim 17 wherein the preset time is about three seconds.

19. The dispenser of claim 15 further comprising a proximity detector operable to detect the user requests and the method performed by the processing device further comprises operating the dispensing mechanism responsive to a signal from the proximity detector.

20. The dispenser of claim 15 wherein the dispensing mechanism comprises:

a drive roller;

a motor in power-transmission relationship with the drive roller;

a tension roller positioned against the drive roller to form a nip therebetween, the towel being drawn through the nip and out of the dispenser by powering of the drive roller; and the processing device controls electrical power to the motor.

* * * * *

UNITED STATES PATENT AND TRADEMARK OFFICE

CERTIFICATE OF CORRECTION

PATENT NO. : 7,594,622 B2
APPLICATION NO. : 11/537867
DATED : September 29, 2009
INVENTOR(S) : Witt et al.

It is certified that error appears in the above-identified patent and that said Letters Patent is hereby corrected as shown below:

In column 8, line 65, delete “602” and insert --502--.

In column 8, line 65, delete “604” and insert --504--.

Signed and Sealed this
Eighth Day of March, 2011

David J. Kappos

David J. Kappos
*Director of the United States Patent and Trademark Office*